US010595596B2

(12) United States Patent
Madsen

(10) Patent No.: US 10,595,596 B2
(45) Date of Patent: Mar. 24, 2020

(54) MODIFIABLE BAND JEWELRY

(71) Applicant: Nova Stella ApS, Copenhagen K (DK)

(72) Inventor: Søren Thisted Madsen, Hørsholm (DK)

(73) Assignee: NOVA STELLA APS, Copenhagen K (DK)

( * ) Notice: Subject to any disclaimer, the term of this patent is extended or adjusted under 35 U.S.C. 154(b) by 649 days.

(21) Appl. No.: 15/109,036

(22) PCT Filed: Dec. 22, 2014

(86) PCT No.: PCT/DK2014/050446

§ 371 (c)(1),
(2) Date: Jun. 29, 2016

(87) PCT Pub. No.: WO2015/101376

PCT Pub. Date: Jul. 9, 2015

(65) Prior Publication Data

US 2016/0309858 A1 Oct. 27, 2016

(30) Foreign Application Priority Data

Dec. 30, 2013 (DK) ..... 2013 00720

(51) Int. Cl.
*A44C 15/00* (2006.01)
*A44C 5/00* (2006.01)
*A44C 17/02* (2006.01)

(52) U.S. Cl.
CPC ..... *A44C 5/0053* (2013.01); *A44C 15/005* (2013.01); *A44C 17/0225* (2013.01)

(58) Field of Classification Search
CPC ..... A44C 5/0053; A44C 5/142; A44C 17/02; A44C 17/0025; A44C 15/009; A44C 15/005; A44C 17/0225; A44C 5/025; A44C 5/022; A44C 5/00; Y10T 29/4959; Y10T 29/49591; Y10T 29/53696
(Continued)

(56) References Cited

U.S. PATENT DOCUMENTS 1,668,217 A 5/1928 Schraysshuen
1,751,383 A * 3/1930 Atkins ..... D04C 1/00 63/38

(Continued)

FOREIGN PATENT DOCUMENTS

GB 2288470 A 10/1995

OTHER PUBLICATIONS

International Search Report for Application No. PCT/DK2014/050446, dated Mar. 24, 2015, 3 pages.

*Primary Examiner* — Jack W Lavinder
(74) *Attorney, Agent, or Firm* — Ziegler IP Law Group, LLC

(57) ABSTRACT

The present invention provides a modifiable band jewelry, which comprises a fibre band made of fibre threads or yarns, said band having one or more openings or loops, and at least one ornament or charm having an upper ornamental part with a lower surface connected to a lower male part, where the ornament or charm is removably attached to the band with the male part being inserted into one of said openings or loops. The fibre band may be made of several fibre threads or yarns being braided, plaited, woven, crocheted, knitted or twisted together, and a major part of the material forming the fibre threads or yarns may be synthetic.

8 Claims, 9 Drawing Sheets

(58) Field of Classification Search
USPC ..... 63/40, 3, 23, 38; 428/32
See application file for complete search history.

(56) References Cited

U.S. PATENT DOCUMENTS

| | | | | |
|---|---|---|---|---|
| 5,031,758 | A * | 7/1991 | Gonzalez | A47F 5/0892 206/6.1 |
| 5,386,710 | A * | 2/1995 | Moore | A44C 15/009 63/15.9 |
| 8,769,986 | B1 | 7/2014 | DiPietro | |
| 2006/0162164 | A1* | 7/2006 | Frisina | A44C 7/00 29/896.43 |
| 2007/0094776 | A1* | 5/2007 | Stevens | A41F 9/002 2/338 |
| 2010/0035000 | A1* | 2/2010 | Kirth | A44C 17/02 428/35.2 |
| 2010/0277943 | A1* | 11/2010 | Hurwitz | A01K 27/006 362/555 |
| 2011/0277501 | A1* | 11/2011 | Davis | A44C 5/0015 63/1.13 |
| 2015/0089812 | A1* | 4/2015 | Guyader | A44C 27/00 29/896.41 |

* cited by examiner

MODIFIABLE BAND JEWELRY

FIELD OF THE INVENTION

The present invention relates to band jewelry, such as band bracelets and necklaces, which can be modified by attaching or removing ornaments, such as bead or charms, to and from the band.

BACKGROUND OF THE INVENTION

Modifiable bracelets as originally made commercially available simply involved a strand, string, or chain having one or both of the end connectors sized to permit the supplemental piece, such as a bead or charm with some sort of port, to pass there over. Upon the joining of the two end connectors, the bead would be retained on the strand, but able to move freely around the strand. The number and size of the beads applied by the wearer to the stand was only limited by the internal. Such bracelets also include bracelets where the strand is braided, such as braided leather bracelet.

Commercially available braided bracelets with charms or beads also include band bracelets, where fasteners are braided into the band, so that different charms or beads can be secured to the band via the fasteners.

The present invention provides a solution for a band jewelry, such as a band bracelet, where beds or charms can be removably attached to the band in a fixed position, but without having fixedly arranged fasteners.

SUMMARY OF THE INVENTION

According to the present invention there is provided a modifiable band jewelry comprising:

- a band made of fibre threads or yarns, said fibre band having one or more openings or loops; and
- at least one ornament having an upper ornamental part with a lower surface connected to a lower male part, said ornament being removably attached to the band with the male part being inserted into one of said openings or loops.

It is preferred that a major part or all of the material forming the fibre threads or yarns is synthetic. Thus, that the band may be made of or comprising synthetic fibre threads or yarns.

The fibre band may be made of or comprising fibre threads or yarns being braided, knotted, plaited, woven, crocheted, knitted and/or twisted together.

According to one or more embodiments of the invention, the lower male part of an ornament has a bottom shoulder part and a body part connecting the shoulder part to the upper ornamental part with the bottom shoulder part having a larger cross-sectional area than the body part and with the upper ornamental part having a cross-sectional area being larger than or equal to the cross-sectional area of the bottom shoulder part. The distance from the lower surface of the bottom shoulder part to the lower surface of the upper ornamental part may be larger than or equal to the thickness of the band part forming the band loop holding the ornament. It is preferred that the ornament and the band loops are dimensioned so that when no force is acted on the band, the open cross-sectional surface area of a band loop or opening holding an ornament is smaller than the cross-sectional area of the bottom shoulder part. It is also preferred that the cross-sectional area of the upper ornamental part is larger than the cross-sectional area of the bottom shoulder part.

According to one or more embodiments of the invention, then at least 6 or 8 fibre threads or yarns are braided, knotted and/or twisted together to form the fibre band with several spacedly arranged loops. It is also within an embodiment of the invention that the fibre band is formed by at least 12 fibre threads or yarns. Preferably, a band loop is formed by two braided or knotted band parts, where each of the braided band parts is formed by at least 2, 3 or 4 fibre threads or yarns.

It is within one or more embodiments of the invention that the fibre band comprises at least one strand with several spacedly arranged loops. Here, the strand may be made of or comprising a number of threads or yarns being at least 6 or 8. All the threads or yarns of a strand may form a single string between the loops, and for each loop the threads may be separated in two parts to form two braided or knotted string parts defining the loop. Here, all the threads or yarns of a strand may form a single braided or knotted string between the loops.

The present invention also covers one or more embodiments where the fibre band comprises at least one strand with several spacedly arranged loops, and wherein for the single string between two loops, a first part of the threads or yarns are used as a core with the remaining part of threads or yarns being braided or knotted around said core.

The present invention further covers one or more embodiments where the fibre band comprises at least one strand with several spacedly arranged loops, and wherein the strand comprises one or more fibre threads or yarns being wound round one or more core threads or yarns. Here, all the core threads or yarns of a strand may be part of a single string between the loops, and for each loop the core threads or yarns may be separated in two parts to form core threads or yarns of two string parts defining the loop.

It is preferred that the fibre threads or yarns of the fibre band are made of or comprises one or more synthetic materials being polyester and/or nylon.

DETAILED DESCRIPTION OF THE INVENTION

Figure 1A:
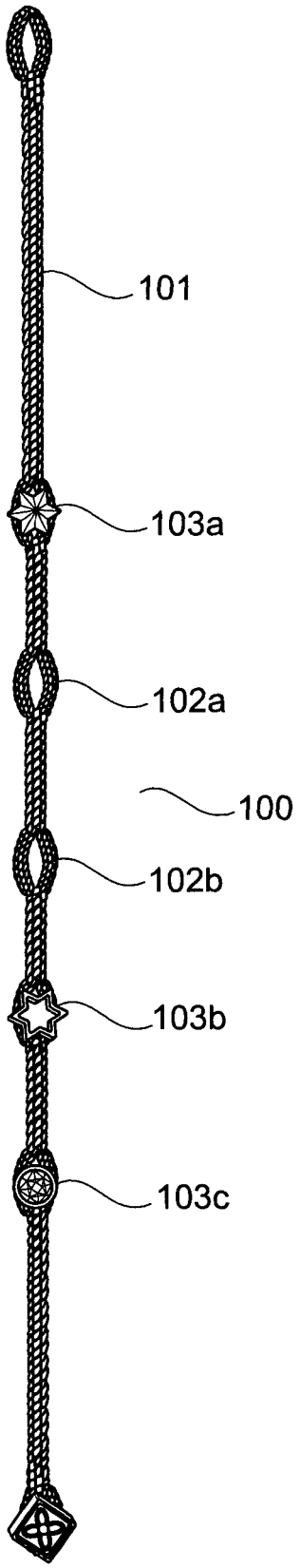
FIGS. 1*a*-1*g* illustrate a first embodiment of a modifiable band jewelry according to the present invention.

In order to produce a band jewelry, such as a band bracelet, where beds or charms can be removably attached to the band in a fixed position, but without having fixedly arranged fasteners, then according to the present invention, the band should have one or more openings or loops, into which a charm can be inserted. It is preferred that the band or the part of the band defining the loops has some elasticity, so that the loops can be enlarged or stretched more open in order to insert a charm, while the band will contract again securing the charm in its position in the band, An essential feature of synthetic or mainly synthetic fibres or yarns is that when they are braided, plaited, woven, crocheted, knitted or twisted together, they become more elastic in use. Thus, when using one of these techniques for producing a band, the band obtains some elasticity, whereby the open cross-sectional surface area of a band loop can be enlarged or stretched more open when a force is exercised by a human hand on the band.

Commonly used materials for producing synthetic or mainly synthetic fibres or yarns include nylon and polyester.

Nylon is a thermoplastic, silky material, first used commercially in a nylon-bristled toothbrush (1938), followed more famously by women's stockings ("nylons"; 1940) after being introduced as a fabric at the 1939 New York World's Fair. Nylon is made of repeating units linked by amide bonds and is frequently referred to as polyamide (PA). Nylon fibers are used in many applications, including clothes fabrics, bridal veils, package paper, carpets, musical strings, pipes, and rope.

Polyethylene terephthalate, commonly abbreviated PET, PETE, is a thermoplastic polymer resin of the polyester family and is used in synthetic fibres; beverage, food and other liquid containers; thermoforming applications; and engineering resins often in combination with glass fibre. The majority of the world's PET production is for synthetic fibres (in excess of 60%), with bottle production accounting for around 30% of global demand. In the context of textile applications, PET is referred to by its common name, "polyester," whereas the acronym "PET" is generally used in relation to packaging. Polyester makes up about 18% of world polymer production and is the third-most-produced polymer; where polyethylene (PE) and polypropylene (PP) are first and second, respectively.

The company Return Textiles has pioneered a high performance eco-textile called Bionic yarn, which may blend petroleum and/or natural based fibres with recycled plastic bottles made of polyethylene terephthalate (PET). Return Textiles' product collection has a wide range of uses in a number of industries, including fashion, outdoor, athletic, automotive, luggage, furniture, uniform, and art.

According to embodiments of the present invention, the band used for the band jewelry can be made by use of yarns supplied by Return Textiles. These yarns and methods for producing them are described in U.S. Pat. No. 7,841,162 B2, which is hereby included by reference. The yarn from Return Textiles comprises an inner portion of spun staple fibers of post consumer recycled (PCR) polyethylene terephthalate (PET or polyester) formed from a pre-extruded liquid polymer insufficiently pure to pass through a twenty micron opening without clogging it; the yarn may further comprise an outer portion comprising fibers of a different material, such as nylon, but natural fiber may also be used for the outer portion. The yarn may also have a core with the inner portion of spun staple fibers surrounding the core, and the outer portion may comprise an inner helix and an outer helix. The core may be a continuous filament core made of nylon having a high tenacity rating.

Figure 1B:
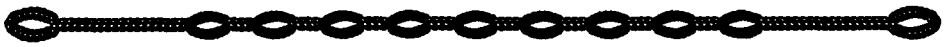

FIGS. 1*a*-1*g* illustrate a first embodiment of a modifiable band jewelry according to the present invention. FIG. 1*a* shows a band jewelry 100, having a one strand fibre band 101 with several spacedly arranged loops 102*a*, 102*b*. Three different ornaments or charms 103*a,b,c* are removably attached to the band 101 by having a male part inserted into corresponding openings or loops 102 of the band 101. The ornaments or charms 103 will be further described in connection with FIGS. 2*a*-2*c*. FIG. 1*b* shows the one strand band 101 without any charms 103 in the loops 102.

Figure 1C:
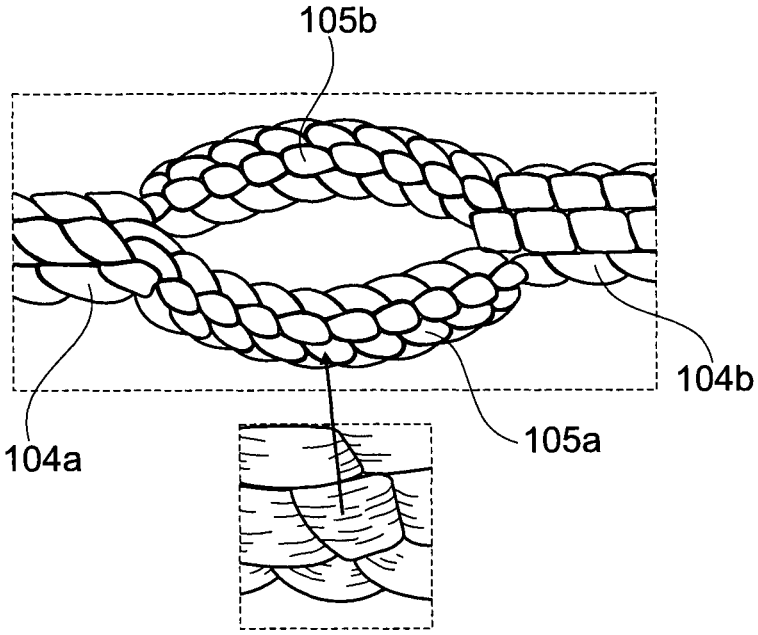
Figure 1D:
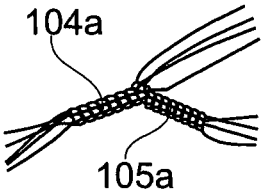
Figure 1E:
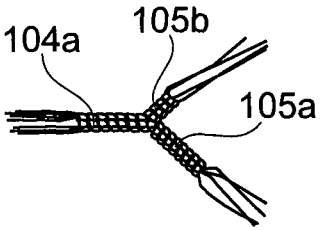
Figure 1F:
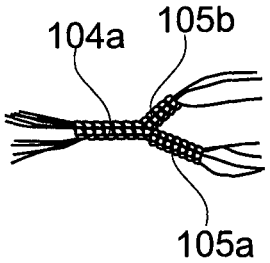
Figure 1G:
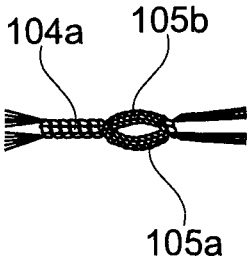

The band 101 is made of eight fibre threads or yarns, which are braided or knotted together as illustrated in FIGS. 1*c*-1*g*. All the threads or yarns form a single braided or knotted string part 104 between the loops 102, and for each loop the threads are separated in two parts to form two braided or knotted string parts defining the loop 102. FIG. 1*c* shows a single loop 102*a* of the band 101, with a braided or knotted string part 104*a*, 104*b* on each side of the loop 102*a*, and with the two braided or knotted loop string parts 105*a*, 105*b* forming the loop 102*a*. All the eight threads or yarns are used for the string parts 104*a*, 104*b*, and four yarns or threads are used for each of the loop string parts 105*a*, 105*b* forming the loop 102*a*. FIG. 1*d* illustrates how the string part 104*a* is braided or knotted with all eight yarns or threads, and the first loop string part 105*a* is braided or knotted with four yarns or threads while the remaining four yarns or threads are left for the second loop string part 105*b*. In FIGS. 1*e* and 1*f* the second loop string part 105*b* is being braided or knotted with the four yarns or threads, and in FIG. 1*g*, the loop 102*a* is finished, and the second string part 104*b* is to be braided or knotted. For the band 101, 14 knots may be used for the string parts 104 between two loops 102, and 9 knots may be used for each of the loop string parts 105*a,b*.

It is preferred that the band 101 is made of or comprises synthetic fibre threads or yarns, with a major part or all of the material forming the fibre threads or yarns being synthetic. The threads or yarns may comprise polyester and/or nylon, such as the yarns produced by Return Textiles as discussed above.

Figure 2A:
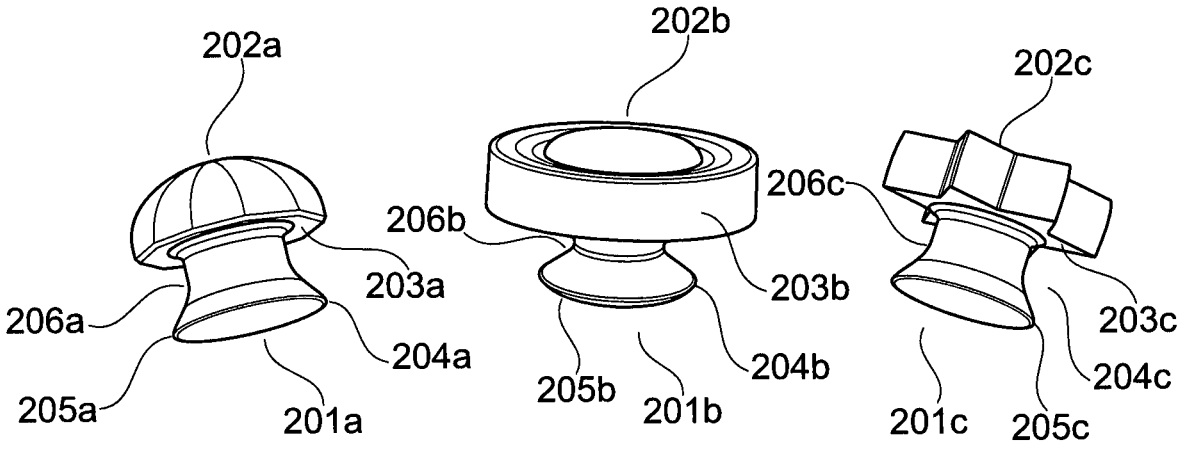
FIGS. 2*a*-2*c* show different views of a three embodiments of a charm ornament for use in a band jewelry according to the present invention, invention.
Figure 2B:
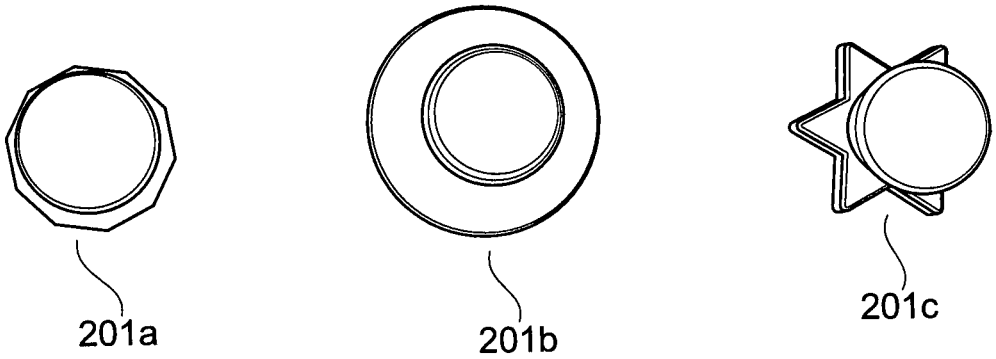
Figure 2C:
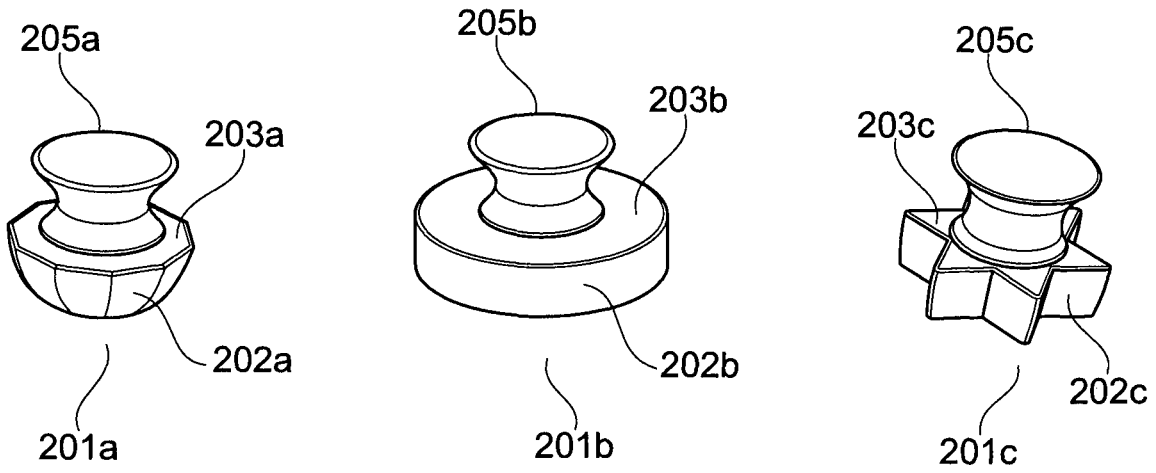

FIGS. 2*a*-2*c* show different views of a three embodiments of a charm ornament 201*a,b,c*, for use in a band jewelry according to the present invention. FIG. 2*a* is a side view of the charms 201*a,b,c* with bottom down, FIG. 2*b* is a bottom view of the charms 201*a,b,c*, and FIG. 2*c* is a side view of the charms 201*a,b,c* with bottom up. Each of the ornaments or charms 201*a,b,c* has an upper ornamental part 202*a,b,c* with a lower surface 203*a,b,c* connected to a lower male part 204*a,b,c*. The ornaments 201*a,b,c* may be removably attached to a band 101 as shown in FIG. 1*a* with the male part 204*a,b,c* being inserted into one of the band openings or loops 102.

Each of the lower male parts 204*a,b,c* has a bottom shoulder part 205*a,b,c* and a body part 206*a,b,c* connecting the shoulder part 205*a,b,c* to the upper ornamental part 202*a,b,c*. The bottom shoulder part 205*a,b,c* has a larger cross-sectional area than the body part 206*a,b,c*, and the upper ornamental part 202*a,b,c* has a cross-sectional area being larger than or equal to the cross-sectional area of the bottom shoulder part 205*a,b,c*. The distance from the lower surface of the bottom shoulder part 205*a,b,c* to the lower surface of the upper ornamental part 203*a,b,c* is larger than or equal to the thickness of the band part 105*a*, 105*b* forming the band loop 102*a* holding the ornament 201*a,b,c*.

The charms or ornaments 201*a,b,c* and the band loops 102 should be dimensioned so that when no force is acted on the band loop 102, the open cross-sectional surface area of the band loop or opening 102 holding an ornament 103, 201, is smaller than the cross-sectional area of the bottom shoulder part 205*a,b,c*. Due to the elasticity of the braided band 101, the bottom shoulder part 205*a,b,c* of the ornament 201*a,b,c* can be pressed through the open cross-sectional surface area of a band loop 102 by a force exercised by a human hand. The cross-sectional area of the upper ornamental part 202*a,b,c* is larger than the cross-sectional area of the bottom shoulder part 205*a,b,c*, making it difficult to press the upper ornamental part 202*a,b,c* through the open cross-sectional surface area of a band loop 102 by a force exercised by a human hand.

The dimensions of a charm or ornament 201*a,b,c* for inserting in a jewelry band 100 of the invention may be around 6 mm for the diameter or side length of the bottom shoulder part 205*a,b,c,* 7-10 mm for the diameter or side length of the upper ornamental part 202*a,b,c*, and a distance or length of 2-3 mm from the lower surface of the bottom shoulder part 205*a,b,c* to the lower surface 203*a,b,c* of the upper ornamental part 202*a,b,c*. For such dimensions of a charm it is preferred that the thickness of the band loop part, into which band loop the charm may be inserted, is in the range of 1-2 mm, such as about 1.5 mm.

Figure 3A:
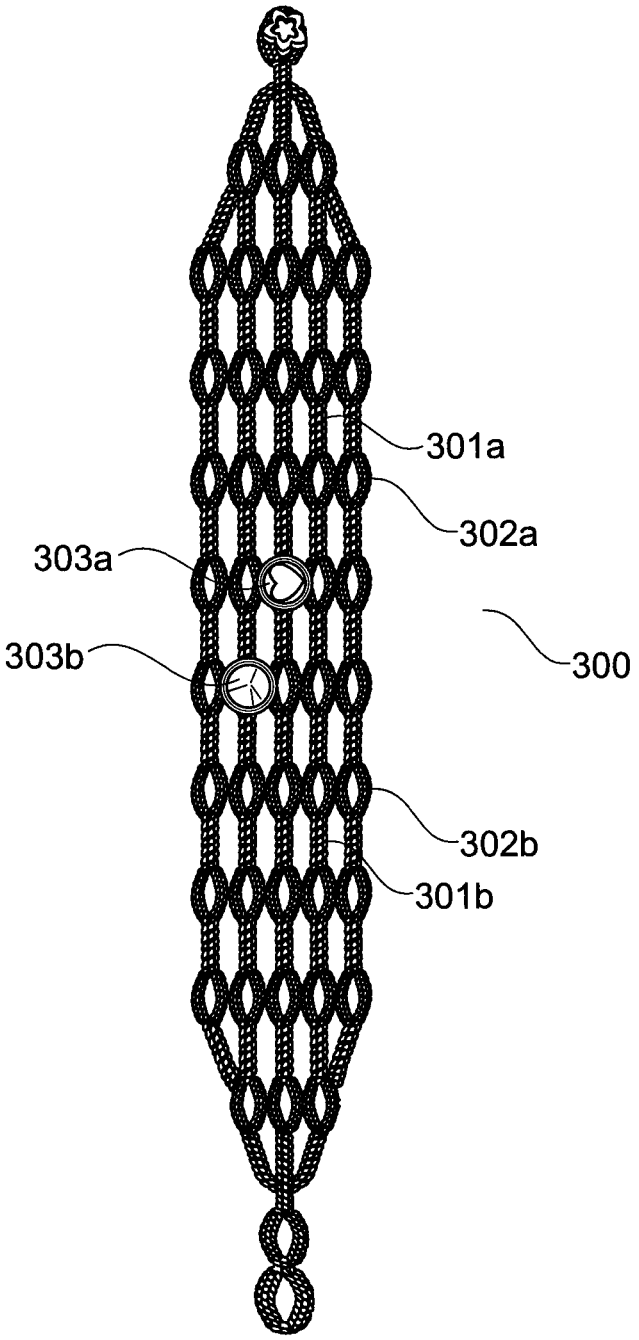
FIGS. 3*a*-3*g* illustrate a second embodiment of a modifiable band jewelry according to the present invention.
Figure 3B:
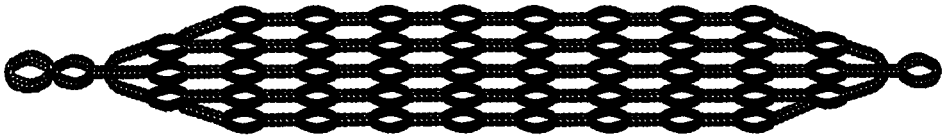

FIGS. 3*a*-3*g* illustrate a second embodiment of a modifiable band jewelry according to the present invention. FIG. 3*a* shows a band jewelry 300, having a plurality of fibre strand bands 301*a,b* with each strand band 301 having several spacedly arranged loops 302*a,b*. Two similar ornaments or charms 303*a,b* are removably attached to the band 300 by having a male part inserted into corresponding openings or loops 302 of a strand band 301. The ornaments or charms 303*a,b* are described in connection with FIGS. 2*a*-2*c*. FIG. 3*b* shows the jewelry band 300 without any charms 303 in the loops 302.

Figure 3C:
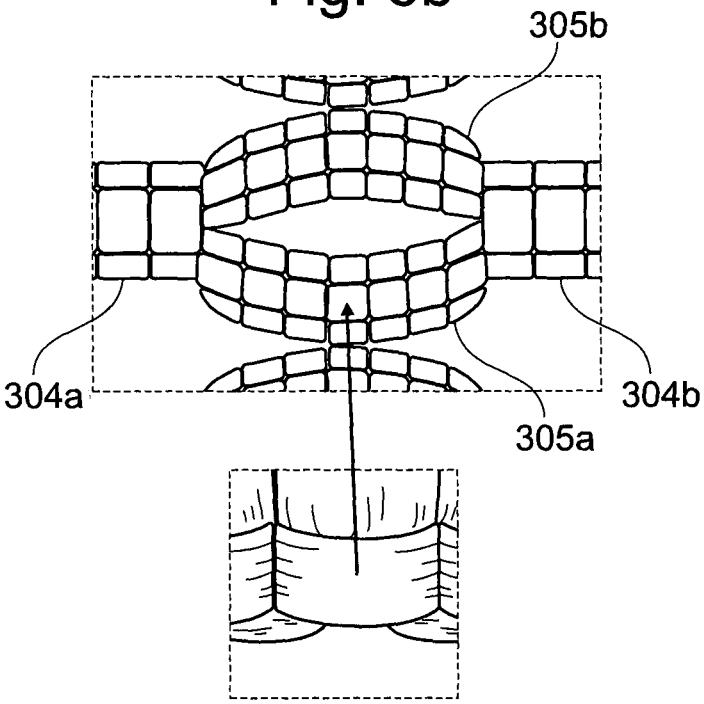
Figure 3D:
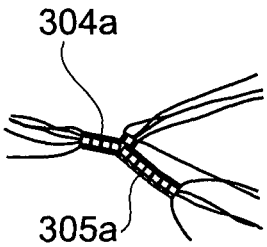
Figure 3E:
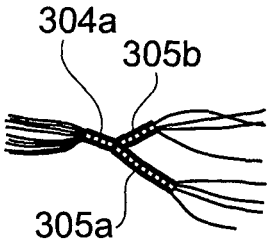
Figure 3F:
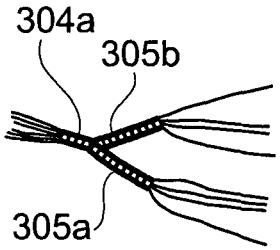
Figure 3G:
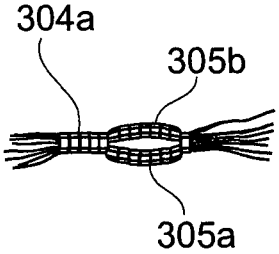

Each of the strand bands 301 is made of eight fibre threads or yarns, which are braided or knotted together as illustrated in FIGS. 3*c*-3*g*. All the threads or yarns form a single braided or knotted string 304 between the loops 302, and for each loop the threads are separated in two parts to form two braided or knotted string parts defining the loop 302. FIG. 3*c* shows a single loop 302*a* of the strand band 301*a* with a braided or knotted string part 304*a*, 304*b* on each side of the loop 302*a*, and with the two braided or knotted loop string parts 305*a*, 305*b* forming the loop 102*a*. All the eight threads or yarns are used for the string parts 304*a*, 304*b*, and four yarns or threads are used for each of the loop string parts 305*a*, 305*b* forming the loop 302*a*. FIG. 3*d* illustrates how the string part 304*a* is braided or knotted with all eight yarns or threads, and the first loop string part 305*a* is braided or knotted with four yarns or threads while the remaining four yarns or threads are left for the second loop string part 305*b*. In FIGS. 3*e* and 3*f* the second loop string part 305*b* is being braided or knotted with the four yarns or threads, and in FIG. 3*g*, the loop 302*a* is finished, and the second string part 304*b* is to be braided or knotted. For each of the strand bands 301, 5 knots may be used for the string parts 304 between two loops 302, and 9 knots may be used for each of the loop string parts 305*a,b*.

It is also here preferred that the string bands 301 are made of or comprises synthetic fibre threads or yarns, with a major part or all of the material forming the fibre threads or yarns being synthetic. The threads or yarns may comprise polyester and/or nylon, such as the yarns produced by Return Textiles as discussed above.

Figure 4A:
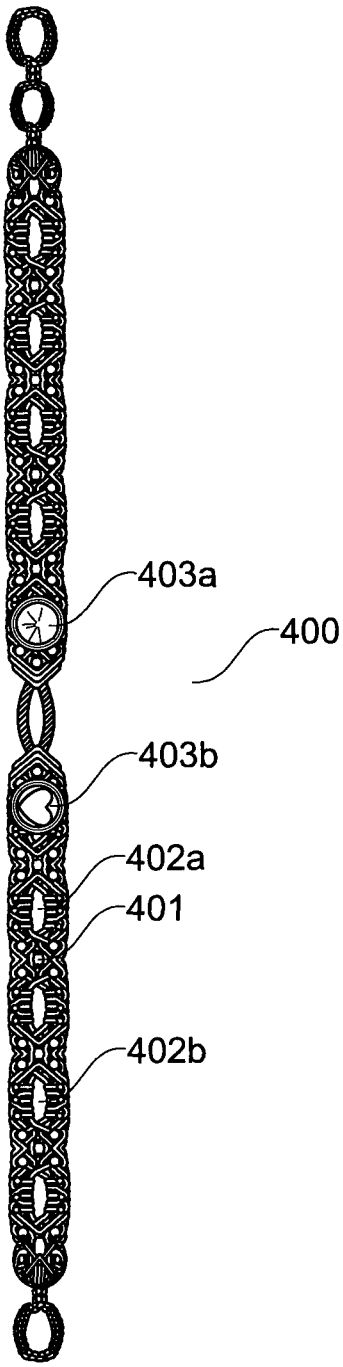
FIGS. 4*a*-4*g* illustrate a third embodiment of a modifiable band jewelry according to the present invention.
Figure 4B:
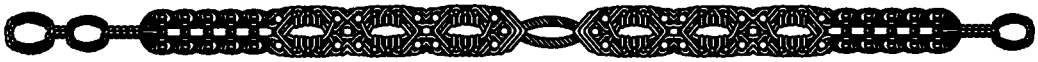

FIGS. 4*a*-4*g* illustrate a third embodiment of a modifiable band jewelry according to the present invention. FIG. 4*a* shows a band jewelry 400, having a fibre band 401 with several spacedly arranged loops 402*a,b*. Two similar ornaments or charms 403*a,b* are removably attached to the band 401 by having a male part inserted into corresponding openings or loops 402 of the band 401. The ornaments or charms 403*a,b* are described in connection with FIGS. 2*a*-2*c*. FIG. 4*b* shows the band 401 without any charms 403 in the loops 402.

Figure 4C:
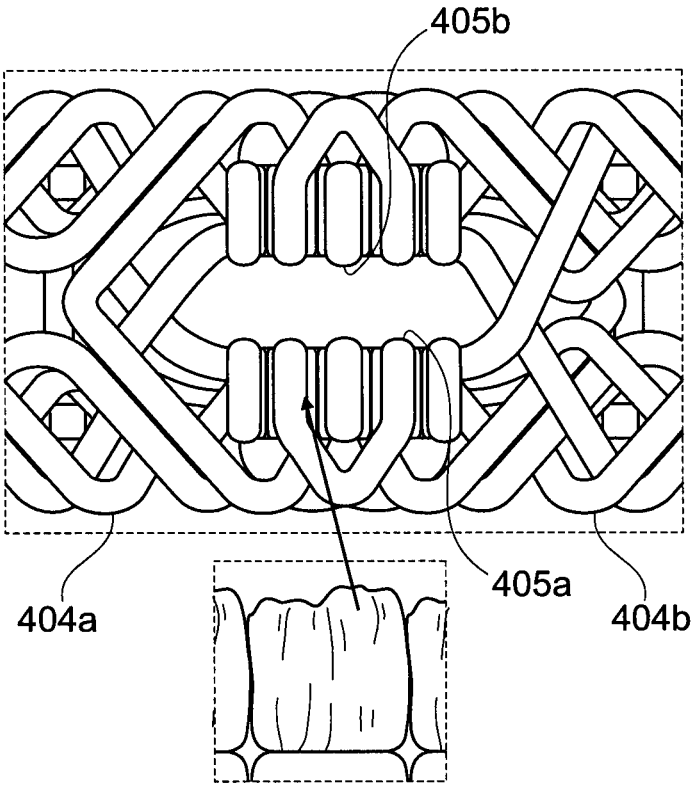
Figure 4D:
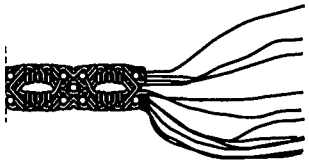
Figure 4E:
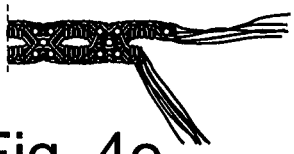
Figure 4F:
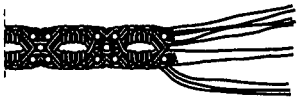
Figure 4G:
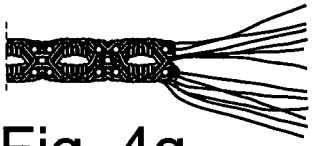

The fibre band 401 is made of 12 fibre threads or yarns, which are braided or knotted together as illustrated in FIGS. 4*c*-4*g*. All the threads or yarns are used for forming the band parts 404*a,b* between two loops 402, and for each loop the threads are separated in two parts to form two braided or knotted loop band parts 405*a* and 405*b* defining the loop 402*a*. FIG. 4*c* shows a single loop 402*a* of the band 401 with a braided or knotted band part 404*a*, 404*b* on each side of the loop 402*a*, and with the two braided or knotted loop band parts 405*a*, 405*b* forming the loop 402*a*.

It is also here preferred that the band 401 is made of or comprises synthetic fibre threads or yarns, with a major part or all of the material forming the fibre threads or yarns being synthetic. The threads or yarns may comprise polyester and/or nylon, such as the yarns produced by Return Textiles as discussed above.

The diameter of the fibre threads or yarns used for the fibre bands 101, 201, 301 may be in the range of 0.1-0.5 mm.

The present invention also covers other embodiments, not illustrated here, wherein the fibre band of the jewelry band comprises at least one strand with several spacedly arranged loops. According to one such embodiment, all the threads or yarns of a strand form a single string between the loops for which single string a first part of the threads or yarns are used as a core with the remaining part of threads or yarns being braided or knotted around said core; for each loop the threads are separated in two parts to form two braided or knotted string parts defining the loop.

According to another embodiment of the invention, wherein the fibre band of the jewelry band comprises at least one strand with several spacedly arranged loops, the strand comprises one or more fibre threads or yarns being wound round one or more core threads or yarns. Here, all the core threads or yarns of a strand are part of a single string between the loops, and for each loop the core threads or yarns are separated in two parts to form core threads or yarns of two string parts defining the loop.

The invention claimed is:

1. A modifiable band jewelry comprising:

a band made of fiber threads or yarns, said band having a plurality of openings or loops; and at least one ornament having an upper ornamental part with a lower surface connected to a lower male part, said at least one ornament being removably attached to the band with the male part being inserted into one of said plurality of openings or loops, wherein at least 6 of said fiber threads or yarns are braided or knotted together to form the band with several of said plurality of openings or loops being spacedly arranged, and wherein at least one of said plurality of openings or loops is formed by two braided or knotted band parts, each of said braided or knotted band parts being formed by at least 3 of said at least 6 fiber threads or yarns.

2. The band jewelry according to claim 1, wherein more than half of the material forming the fiber threads or yarns is synthetic.

3. The band jewelry according to claim 1, wherein the lower male part of said at least one ornament has a bottom shoulder part and a body part connecting the bottom shoulder part to the upper ornamental part with the bottom shoulder part having a larger cross-sectional area than the body part and with the upper ornamental part having a cross-sectional area being larger than the cross-sectional area of the bottom shoulder part; and wherein the distance from a lower surface of the bottom shoulder part to the lower surface of the upper ornamental part is larger than or equal to a thickness of one of the two braided or knotted band parts forming the band loop holding the at least one ornament.

4. The band jewelry according to claim 3, wherein when no force is applied to the band, an open cross-sectional surface area of said plurality of openings or loops holding said at least one ornament is smaller than the cross-sectional area of the bottom shoulder part.

5. The band jewelry according to claim 1, wherein the band comprises at least one strand, and wherein all the fiber threads or yarns of said at least one strand form a single string between two spacedly arranged openings or loops of the plurality of openings or loops, and wherein the single string of fiber threads or yarns is separated to form said two braided or knotted band parts defining the at least one of the plurality of openings or loops.

6. The band jewelry according to claim 5, wherein for the single string between said two spacedly arranged openings or loops, a first part of the fiber threads or yarns is used as a core with the remaining part of the fiber threads or yarns being braided or knotted around said core.

7. The band jewelry according to claim 1, wherein at least 8 or 12 fiber threads or yarns of said at least 6 fiber threads or yarns are braided or knotted together to form the band with several spacedly arranged openings or loops.

8. The band jewelry according to claim 7, wherein at least one of said several spacedly arranged openings or loops is formed by said two braided or knotted band parts, the two braided or knotted band parts being formed by at least 4 of the at least 8 or 12 fiber threads or yarns.

* * * * *